US006120673A

United States Patent [19]

Reiter et al.

[11] Patent Number: 6,120,673

[45] Date of Patent: Sep. 19, 2000

[54] METHOD AND DEVICE FOR REGENERATING TIN-PLATING SOLUTIONS

[75] Inventors: Ulrich Reiter; Werner Harnischmacher, both of Osnabrück; Klaus Fischwasser, Dresden; Hans-Wilhelm Lieber; Ralph Blittersdorf, both of Berlin; Annette Heuss, Teltow, all of Germany

[73] Assignee: KM Europa Metal AG, Osnabruck, Germany

[21] Appl. No.: 09/074,725

[22] Filed: May 7, 1998

[30] Foreign Application Priority Data

May 7, 1997 [DE] Germany ..... 197 19 020

[51] Int. Cl.[7] ..... C25C 1/14

[52] U.S. Cl. ..... 205/611; 204/93; 204/232; 204/241; 204/253; 204/292; 204/293; 204/522; 204/528; 204/633; 204/DIG. 13; 205/611; 205/770

[58] Field of Search ..... 204/522, 528, 204/633, 253, 232, 241, DIG. 13, 93, 292, 293; 205/611, 770

[56] References Cited

U.S. PATENT DOCUMENTS 3,764,503 10/1973 Lancy et al. ..... 204/522
4,330,377 5/1982 Franks, Jr. ..... 204/93

FOREIGN PATENT DOCUMENTS 27 42 718 4/1979 Germany .
43 10 366 10/1994 Germany .

*Primary Examiner*—Kathryn Gorgos
*Assistant Examiner*—Christopher Keehan
*Attorney, Agent, or Firm*—Kenyon & Kenyon

[57] ABSTRACT

The invention relates to a method and a device for regenerating exhausted tin-plating solutions which contain tin and copper ions, free complexing agent and complexing agent bound to the copper ions, as well as expended and unexpended reducing agent. By means of a suitable rinsing technique, the rinse water of the tin-plating process is concentrated to a 10 to 15 percent dilution of the process solution. The regenerating solution thus produced is fed to an electrolytic cell. The electrolytic cell comprises a cathode chamber, a middle chamber and an anode chamber. The cathode chamber is separated from the middle chamber by an anion-exchange membrane and the anode chamber is separated from the middle chamber by a cation-exchange membrane. The regenerating solution is initially provided in the cathode chamber. Here, the interfering copper component is cathodically deposited. After an appropriate residence time, the regenerating solution, depleted of copper, is transferred by pumping into the middle chamber where tin enrichment is effected by tin ions diffused from the anode chamber through the cation-exchange membrane. The regenerated solution is subsequently fed back into the tin-plating process.

14 Claims, 1 Drawing Sheet

METHOD AND DEVICE FOR REGENERATING TIN-PLATING SOLUTIONS

FIELD OF THE INVENTION

The invention relates to a method and a device for regenerating exhausted tin-plating solutions.

BACKGROUND OF THE INVENTION

The electroless tin-plating of copper workpieces on the outside by means of an aqueous tin-plating solution is a common process in surface-coating technology. It is used, for example, for tin-plating the inside of copper pipes or tin-plating printed circuit boards for integrated circuits.

The tin-plating solution contains aqueously dissolved tin ions that are deposited on the copper by chemical reduction using a suitable reducing agent. In doing this, an exchange between the metals takes place at the surface of the copper workpieces, which is made possible by a complexing agent contained in the tin-plating solution. Hypophosphite is used primarily as the reducing agent and thiourea is typically used as the complexing agent.

By lowering the redox (oxidation-reduction) potential of copper in the coordinated form, copper goes into solution and tin deposits on the surface of the copper workpiece. Since no free electrons appear during this type of chemical reaction, the oxidation of one reaction partner is always accompanied by the reduction of another.

Consequently, an enrichment of copper and a depletion of tin in the tin-plating solution is associated with the process of electroless tin-plating. Therefore, in conventional operation, the tin and the complexing agent must be regenerated until a limiting concentration of copper is reached, at which point the solution is unusable and must be replaced. In addition, the reducing agent must be regenerated from time to time, since it is expended when, after achieving a complete tin coating, further metal still needs to be deposited.

The exhausted tin-plating solution then contains tin and copper ions, free complexing agent and complexing agent bound to the copper ions, expended and unexpended reducing agent, and possibly other constituents subject to the process technology.

To regenerate a galvanic tin-plating electrolyte, DE 27 42 718 A1 proposes removing the tin ions first of all by means of electrolysis and then, subsequently, removing the foreign-metal ions in a cation exchanger.

Regarded as related art through DE 43 10 366 C1 is a method and device for regenerating aqueous coating solutions, working with zero current on the outside, for metal coating by means of metal ions and a reducing agent. In this case, an ion-exchange process is carried out in combination with the electrolytic electrode reactions.

The process takes place in an electrolytic cell having at least four chambers. Electrolytic regeneration is achieved during the process by reducing orthophosphite to hypophosphite in a cathode chamber and by electrodialytic provision of counterion-free regenerating chemicals.

Electrolytic regeneration of tin-plating solutions, working in an electroless manner on the outside, could not be practiced successfully till now, since the thermodynamic potentials of the coordinated copper and tin tend to prohibit such copper deposition.

SUMMARY OF THE INVENTION

It is to this problem that the object of the present invention is directed, that is, to set forth a method and device which make it possible to separate the accumulating, interfering copper component by cathodic deposition, and at the same time to regenerate the exhausted tin component, thus markedly prolonging the utilization time, i.e., service life of tin-plating solutions for copper workpieces, working with zero current on the outside.

The method portion of this objective is achieved by providing a method for regenerating an aqueous tin-plating solution for copper workpieces which works with zero current on the outside and which contains tin and copper ions, free complexing agent and complexing agent bound to the copper ions, as well as expended and unexpended reducing agent. In this method, a regenerating solution containing diluted tin-plating solution is fed to an electrolytic cell which comprises a cathode chamber having an incorporated cathode, a middle chamber and an anode chamber having an incorporated anode and filled with an anolyte, a potential difference being applied between the anode and the cathode. The cathode chamber is separated from the middle chamber by an anion-exchange membrane and the anode chamber is separated from the middle chamber by a cation-exchange membrane, the regenerating solution being provided initially in the cathode chamber and residing there with deposition of copper on the cathode. After a residence time, the regenerating solution, depleted of copper, is transferred into the middle chamber where a tin enrichment is effected by tin ions passed through the cation-exchange membrane from the anode chamber.

The device portion of this objective can be achieved by providing a device for regenerating an aqueous tin-plating solution for copper workpieces comprising an electrolytic cell. The electrolytic cell comprises a cathode chamber having an incorporated cathode, a middle chamber and an anode chamber having an incorporated anode. The cathode chamber is separated from the middle chamber by an anion-exchange membrane, and the anode chamber is separated from the middle chamber by a cation-exchange membrane. A potential difference is capable of being applied between the anode and the cathode. Additionally, the temperature in the electrolytic cell may be between 10° C. and 60° C.

Forming the crux of the invention is the step of regenerating exhausted tin-plating solution in strong dilution. According to the invention, a combination is made of electrolytic electrode reactions and of transfer processes in ion-exchange membranes. In carrying this out, copper is depleted by cathodic deposition from a dilution of the tin-plating solution, and tin is enriched by anodic dissolution and transfer through a cation-exchange membrane.

In this context, the invention makes us of the knowledge that, since a regenerating solution in which the tin-plating solution used during the tin-plating process is present in a strongly diluted form, deposition relationships with respect to the originally-concentrated tin-plating solution become reversed, and copper preferentially precipitates out of the thermodynamically disadvantaged copper complex. In this manner, the interfering copper component can be depleted, and the tin component necessary for the process can be supplied by anodic dissolution.

The regenerating solution is fed to an electrolytic cell which comprises a cathode chamber with integrated cathode, a middle chamber and an anode chamber with integrated anode and filled with an anolyte. The cathode chamber is separated from the middle chamber by an anion-exchange membrane, whereas a cation-exchange membrane is incorporated between the anode chamber and the middle chamber. An electric potential difference is applied between the anode and the cathode.

In the electrolytic cell, the regenerating solution is provided initially in the cathode chamber and resides there, with deposition of copper on the cathode. The residence time is a function of the total amount of metal fed. The regenerating solution, depleted of copper, is subsequently transferred into the middle chamber, where tin enrichment is effected by the tin ions passed through the cathode-exchange membrane from the anolyte of the anode chamber.

Thereupon, the prepared regenerating solution, enriched with tin, can be conveyed from the middle chamber for further use.

Expediently, the prepared regenerating solution is led back into the tin-plating process, where it also compensates for the water losses occurring there due to evaporation.

The regenerating solution is made of a 5 to 50% dilution of the tin-plating solution. A concentration range between 10 to 15% is regarded as particularly advantageous.

Even if in principle it is possible to obtain the regenerating solution by drawing off the tin-plating solution from the coating process and admixing a suitably high quantity of water, a particularly advantageous further development of the method of the present invention is rinsing of the copper workpieces wherein the regenerating solution contains 10% to 15% of the tin-plating solution. Accordingly, the regenerating solution is obtained from a rinsing process of the copper workpieces.

The rinse water, concentrated by a suitable rinsing technique, which has an electrolyte concentration of preferably 10 to 15% of the process solution, is then transferred into the cathode chamber of the electrolytic cell.

The dilution of the tin-plating solution, which results automatically during the rinsing process and is brought to the required concentration range by suitable rinsing techniques, makes possible the cathodic deposition of copper from the complex as against tin even though the thermodynamic redox potentials would not lead one to expect this.

The copper ions contained in the regenerating solution are cathodically deposited. The tin ions likewise contained in the regenerating solution are cathodically co-deposited in small measure as well. The ions of the reducing agent can diffuse through the ion-exchange membranes into the middle chamber, in which is located the regenerating solution of the preceding regeneration cycle. It is already depleted of copper.

After the copper enrichment in the cathode chamber, the regenerating solution is conveyed into the middle chamber in which the tin enrichment takes place.

In carrying this out, tin ions, which are anodically disintegrated in the anode chamber, come by diffusion from the anode chamber, through the cation-exchange membrane, into the middle chamber. The anions of the reducing agent are prevented from a passage into the anode chamber by the cation-exchange membrane, so that they remain in the middle chamber.

DETAILED DESCRIPTION OF THE INVENTION

According to the invention, the combination of the electrolytic electrode reactions and of the transfer processes in the ion-exchange membranes permits a selective deposition of the interfering copper component from a regenerating solution in the form of diluted tin-plating solution.

Subsequent to the tin enrichment, the regenerated solution is fed back into the tin-plating process and revives the tin-plating solution. Due to this, the service life and utilization time of the tin-plating solution is markedly prolonged.

Sulphuric acid, preferably in a concentration between 3% and 6%, is used as anolyte which is transferred in a separate circulation step. Here, an anodic disintegration of the tin proceeds without polarization effect, with nearly 100% current efficiency.

Alternatively, tetrafluoroboric acid or methane sulphonic acid can also be used as anolyte. For example, 3 to 6 percent sulphuric acid may be used as anolyte.

In further accordance to the present invention, the temperature in the electrolytic cell is between 10° C. and 60° C. The cathodic depletion of copper and enrichment of tin proceeds best in a temperature range between 30° C. and 40° C.

The regenerating solution is moved into the electrolytic cell. This transfer can be effected, for example, by pumping from chamber to chamber or by agitation in the chambers. This prevents polarization effects in the chambers, particularly at the membrane surfaces.

To assure optimal regeneration conditions, the temperature of the electrolytic cell can be controllable.

The method of the present invention can be implemented both in continuous fixed-cycle operation and in batch operation.

The regenerating solution can either be conducted quasi-continuously in two cycles through the cathode chamber and the middle chamber, respectively, of the three-chamber membrane electrolysis; or a portion of the tin-plating solution, diluted as charge stock, can be regenerated in the cell and subsequently fed back to the tin-plating solution.

Preferably, the cathode material is made of copper or high-grade steel. The anode material is made of tin. This is a prerequisite for the tin enrichment during the regeneration process.

Since a tin-plating process is usually carried out at temperatures between 70° C. and 80° C., correspondingly high evaporation losses occur in the tin-plating solution. The prepared regenerating solution that is supplied compensates for this. If necessary, it is possible to make a process-dependent correction or adjustment of the regenerating solution to suit the needs. In this manner, a more favorable water recirculation is also achieved by the method of the present invention.

According to another advantageous feature of the present invention, two or more electrolytic cells can be connected stack-wise one after the other (series connection) or side by side in parallel (parallel connection). With these means, a high capacity is provided for the treatment of exhausted tin-plating solutions.

In the following, the invention is explained more precisely by an example and a figure.

The example relates to a tin-plating electrolyte for outer electroless tin-plating, said tin-plating electrolyte being synthesized on a fluoroborate base with the complexing agent thiourea and the reducing agent hypophosphite.

The data specified in the following table are valid for the example:

Redox Potentials

| | | | | |
|---|---|---|---|---|
| $Sn^{2+}$ | $+2\ e^-$ | ⇆ | Sn | $E_o = -0.14$ V |
| $[Cu(TH)_x]^+$ | $+e^-$ | ⇆ | Cu+ × TH | $E_o \cong -0.45$ V |

where x=4, (3) and TH=thiourea, from polarographic data [J. Am. Chem. Soc., 72,4724, (1950)]

| | | | | |
|---|---|---|---|---|
| $Cu^+$ | $+e^-$ | ⇆ | Cu | $E_o = +0.52$ V |
| $Cu^{2+}$ | $+2\ e^-$ | ⇆ | Cu | $E_o = +0.34$ V |
| $2H_2O$ | $+2\ e^-$ | ⇆ | $H_2 + 2\ OH^-$ | $E_o = -0.81$ V |
| $4H^+$ | $+O_2 + 4\ e^-$ | ⇆ | $2\ H_2O$ | $E_o = +1.23$ V |
| $H_3PO_3$ | $+2H^+ + 2\ e^-$ | ⇆ | $H_3PO_2 + 2\ H_2O$ | $E_o = -0.50$ V |

Formation [stability ] Constants $K_s(Cu(TH)_2^+)=2.0\times10^{12}$ $K_s(Cu(TH)_3^+)=2.0\times10^{14}$ $K_s(Cu(TH)_4^+)=3.4\times10^{15}$ or $2.4\times10^{15}$ from [Inorg. Chem., 15,940, (1976)] and [J. Am. Chem. Soc., 72,4724, (1950)]

Specified in the table, besides the reaction equilibria for the system of tin ions, coordinate copper ions and anions of the reducing agent, are also those of the chemical water electrolysis, since these must also be taken into account in the case of membrane electrolysis, especially given the strongly diluted solutions.

Based on the data, it turns out that free copper, both as Cu(I) and as Cu(II), could preferentially be deposited as against tin. Since, however, the copper exists exclusively as coordinated copper, a tin deposition takes place. This is also the case in concentrated solutions.

The result of the invention is that, since the regenerating solution in which the tin-plating solution exists is in the dilution indicated, electrode-kinetic effects (passage reaction, exchange current density, overvoltage) play an increasingly more important role, so that in spite of the unfavorable chemical potential relationships, copper can be preferentially deposited.

The course of the regeneration process of a tin-plating solution is explained in FIG. 1. The reaction equilibria, redox potentials and formation constants that are important for the system are in the table above.

BRIEF DESCRIPTION OF THE DRAWINGS

Designated by 1 in FIG. 1 is an installation for the electroless tin-plating of copper workpieces on the outside by means of an aqueous tin-plating solution.

Subsequent to the tin-plating process, the copper workpieces are cleaned in a rinsing process. The rinsing process is indicated by SP, the water feed is indicated by the arrow W. In this case, the portion dragged out from the tin-plating solution by electrolyte is diluted by the rinse water. By a suitable rinsing technique, the rinse water is concentrated to a 10 to 15% dilution of the process solution.

Figure 1:
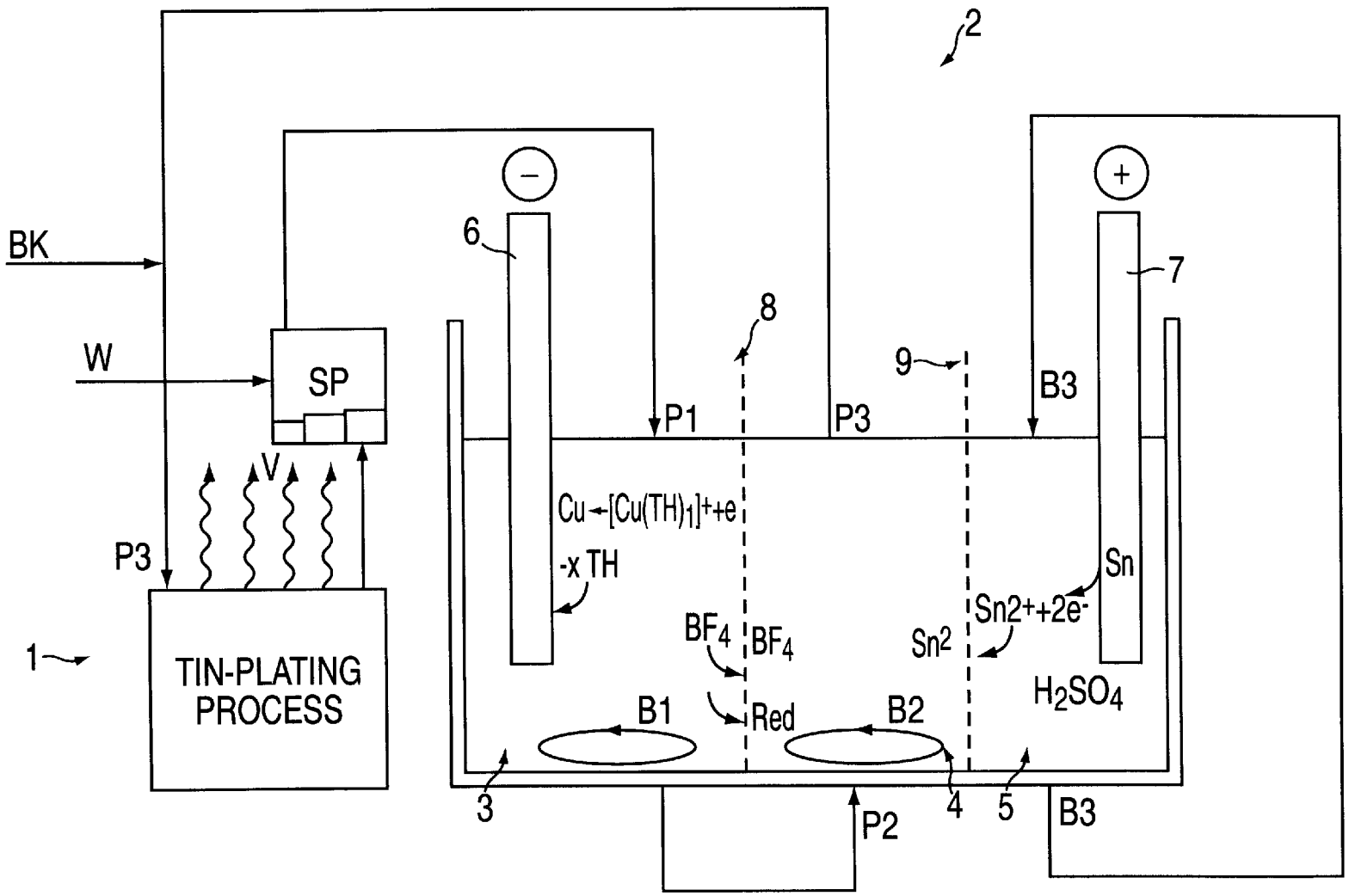

The regenerating solution thus produced is fed to a three-chamber electrolytic cell 2. The electrolytic cell comprises a cathode chamber 3, a middle chamber 4 and an anode chamber 5.

Located in cathode chamber 3 is a cathode 6 of copper; an anode 7 of tin is arranged in anode chamber 5. A potential difference is applied between anode 7 and cathode 6.

Cathode chamber 3 is separated from middle chamber 4 by an anion-exchange membrane 8, and anode chamber 5 is separated from middle chamber 4 by a cation-exchange membrane 9.

The regenerating solution is initially conducted into cathode chamber 3 (arrow P1). The interfering copper component is then cathodically deposited to over 95% from the thiourea complex at a current density of 0.4 to 0.6 A/dm$^2$, and is thus removed from the system. At the same time, anions such as the tetrafluoroborate anion and the hypophosphite anion can pass through anion-exchange membrane 8 into middle chamber 4.

A co-deposition of the tin of less than 35%, the decomposition of water by hydrogen evolution, and a reduction of orthophosphite constituents to hypophosphite by way of the forming hydrogen can occur as secondary reactions. The water electrolysis, in particular, because of the dilution, results in a lower current efficiency (approximately 40%) with respect to the metal deposition.

After a residence time corresponding to the quantity of metal to be deposited, the contents of cathode chamber 3 are transferred by pumping into middle chamber 4 (see arrow P2). Here a tin enrichment takes place by tin ions which diffuse from anode chamber 5 through cation-exchange membrane 9. Because of cation-exchange membrane 9, the tetrafluoroborate ions and hypophosphite ions cannot pass through into anode chamber 5.

Subsequent to the tin enrichment, the regenerated solution can be fed back into the tin-plating process (arrow P3). The evaporation losses occurring during the tin-plating process can also be compensated by this means. The evaporation occurring during the tin-plating process is indicated by arrows V. If necessary, a requisite correction (arrow BK) of the prepared, diluted solution can be made in response to the requirements of the tin-plating solution from the standpoint of process technology.

The respective electrolytic solutions in the three reaction chambers (cathode chamber 3, middle chamber 4, anode chamber 5) are moved, thus preventing polarization effects in reaction chambers 3,4,5, especially at the membrane surfaces. The movement in cathode chamber 3 and in middle chamber 4 is indicated by arrows B1 and B2. Movement B1 and B2 can be effected, for example, by agitation. The anolyte ($H_2SO_4$) in anode chamber 5 is transferred in a separate circulation step. This is indicated by arrow B3.

The combination of electrolytic electrode reactions and the transfer processes in ion-exchange membranes thus permits a selective deposition of the interfering copper component from a diluted tin-plating solution, accompanied by simultaneous enrichment of tin by anodic dissolution and transfer of tin ions through the cation-exchange membrane. The regenerated solution is returned into the tin-plating solution of the tin-plating process. Due to this, the service life, i.e., the utilization time of the tin-plating solution, is markedly prolonged.

According to the invention, it is possible to connect two or more of the previously described electrolytic cells 2 stack-wise one after the other (series connection) or side by side in parallel (parallel connection). In this manner, the capacity, designed in each case to suit the needs, for the preparation of tin-plating solutions is achieved.

Reference Numeral List

| | |
|---|---|
| 7 | Tin-plating installation |
| 2 | Electrolytic cell |
| 3 | Cathode chamber |
| 4 | Middle chamber |
| 5 | Anode chamber |

-continued

| | |
|---|---|
| 6 | Cathode |
| 7 | Anode |
| 8 | Anion-exchange membrane |
| 9 | Cation-exchange membrane |
| B1 | Arrow |
| B2 | Arrow |
| B3 | Arrow |
| BK | Requisite correction |
| P1 | Arrow |
| P2 | Arrow |
| P3 | Arrow |
| SP | Rinsing process |
| V | Evaporation |

What is claimed is:

1. A method for regenerating an aqueous tin-plating solution for copper workpieces which works with zero current on the outside and which contains tin and copper ions, free complexing agent and complexing agent bound to the copper ions, as well as expended and unexpended reducing agent, wherein a regenerating solution containing diluted tin-plating solution is fed to an electrolytic cell which comprises a cathode chamber having an incorporated cathode, a middle chamber and an anode chamber having an incorporated anode and filled with an anolyte, a potential difference being applied between the anode and the cathode, the cathode chamber being separated from the middle chamber by an anion-exchange membrane and the anode chamber being separated from the middle chamber by a cation-exchange membrane, the regenerating solution being provided initially in the cathode chamber and residing there with deposition of copper on the cathode, and that after a residence time, the regenerating solution, depleted of copper, is transferred into the middle chamber where a tin enrichment is effected by tin ions passed through the cation-exchange membrane from the anode chamber.

2. The method according to claim 1 wherein the regenerating solution contains between 5% and 50% of the tin-plating solution.

3. The method according to claim 1 wherein the regenerating solution contains 10% to 15% of the tin-plating solution.

4. The method according to claim 1 wherein the regenerating solution is obtained from a rinsing process of the copper workpieces.

5. The method according to claim 1 wherein the anolyte is transferred in a circulation step.

6. The method according to claim 1 wherein 3 to 6 percent sulphuric acid is used as anolyte.

7. The method according to claim 1 wherein a tetrafluoroboric acid or a methane sulphonic acid is used as anolyte.

8. The method according to claim 1 wherein the temperature in the electrolytic cell is between 10° C. and 60° C.

9. The method according to claim 1 wherein the temperature in the electrolytic cell is between 30° C. and 40° C.

10. A device for regenerating an aqueous tin-plating solution for copper workpieces comprising an electrolytic cell which comprises a cathode chamber having an incorporated cathode, a middle chamber and an anode chamber having an incorporated anode, the cathode chamber being separated from the middle chamber by an anion-exchange membrane, and the anode chamber being separated from the middle chamber by a cation-exchange membrane, a potential difference being capable of being applied between the anode and the cathode, wherein the anode is made of tin and the cathode is made of copper or high-grade steel, the middle chamber has means for effecting a tin enrichment in the middle chamber which includes a regenerating solution, by production of tin ions which diffuse from the anode chamber through the cation-exchange membrane.

11. The device of claim 10 wherein the regenerating solution is movable in the electrolytic cell.

12. The device of claim 10 wherein the temperature of the electrolytic cell is controllable.

13. The device of claim 10 wherein a plurality of electrolytic cells are connected one after the other.

14. The device of claim 10 wherein the plurality of electrolytic cells are connected side by side in parallel.

* * * * *